United States Patent [19]

Kroon

[11] 4,080,024

[45] Mar. 21, 1978

[54] UNDERGROUND CABLE CONNECTION

[75] Inventor: David H. Kroon, Hanover Park, Ill.

[73] Assignee: Harco Corporation, Medina, Ohio

[21] Appl. No.: 796,174

[22] Filed: May 12, 1977

[51] Int. Cl.[2] ..... H01R 3/06

[52] U.S. Cl. ..... 339/14 R; 174/78; 339/177 R; 339/251

[58] Field of Search ..... 339/14 R, 14 L, 13, 339/177, 251; 174/78

[56] References Cited

U.S. PATENT DOCUMENTS

| | | | |
|---|---|---|---|
| 759,414 | 5/1904 | Bishop | 339/251 X |
| 3,452,318 | 6/1969 | Tanges, Jr. | 339/177 R X |
| 3,579,173 | 5/1971 | Greener | 339/251 X |
| 3,887,895 | 6/1975 | Pierzchala | 339/14 R |

*Primary Examiner*—Roy Lake

*Assistant Examiner*—DeWalden W. Jones

*Attorney, Agent, or Firm*—Donnelly, Maky, Renner & Otto

[57] ABSTRACT

An electrical connection for all of the exposed concentric neutrals of underground direct burial power cables made from a kit including a soft, completely tin-coated, L-shaped copper sleeve wrapped about the cable, the short leg of the L forming a projecting tab. A ring-tong crimp type connector is bolted to the tab and the entire bolted connection and crimp connector is dip soldered. After the sleeve is wrapped about the cable, it is surrounded by a rubber gasket field cut to fit. A hose clamp having a special metal shim constricts the sleeve causing good electrical contact with all of the exposed concentric neutrals and secures the sleeve in place. A lead wire is then crimped in place in the crimp type connector.

16 Claims, 6 Drawing Figures

UNDERGROUND CABLE CONNECTION

This invention relates generally as indicated to an underground cable connection, and more particularly to a cable clamp achieving positive electrical contact with all of the concentric exposed neutrals of underground residential distribution cable.

The electric utility industry has been utilizing direct burial power cables for rural or residential electrical distribution, such underground residential distribution cable being known as URD cable. Some of such URD cable is provided with a copper concentric neutral wrapped around the outside of the cable. The neutral may take the form of copper wire or flat copper strap applied spirally exteriorly of an extruded layer of semiconducting material.

In some locations, the exposed copper of the neutral has corroded and this can create a hazardous condition. To protect the copper against further corrosion or to retard corrosion, cathodic protection utilizing magnesium or zinc anodes has been employed. To be effective, the anode must be positively electrically connected to all of the URD concentric neutrals. It is, of course, important that the electrical connection between the anode and the cable neutrals be made quickly and positively without damage to the cable.

Prior attempts have been made to provide such positive electrical connection by placing a contact sleeve beneath the neutral wires or between such wires and the semiconductor shield. In field installations, it is, of course, difficult to get an inner sleeve under the neutral wires without damaging the semiconductor. Damage to the semiconductor may be quite significant, since if the semiconductor is gouged or dented, it may set up a stress point which would be susceptible to cable failure.

Other attempts have been made to obtain an effective connection for all of the exposed neutrals, but such connectors generally require an extensive amount of field fabrication, particularly if different size cables are involved. Moreover, with conventional bolted cable clamps, excessive stresses may be imposed on the semiconductor.

It is accordingly a principal object of the present invention to provide a URD cable clamp which will achieve a positive electrical contact between a lead wire and all of the URD exposed concentric neutrals.

Another principal object is the provision of such cable clamp or connection which can readily be field applied from a simplified kit without extensive field fabrication.

Another important object is the provision of an electrical connection for underground direct burial power cables which includes a completely tinned copper sleeve wrapped around the neutrals of the cable, such sleeve being provided with a tab having secured thereto a crimp or compression connector.

A further object is the provision of a URD cable clamp which does not require placement of a conductor between the neutral wires and the semiconductor therebeneath.

Still another object is the provision of a kit from which the aforementioned electrical connection can quickly be field fabricated.

These and other objects and advantages of the invention will become apparent as the following description proceeds.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

Figure 1:
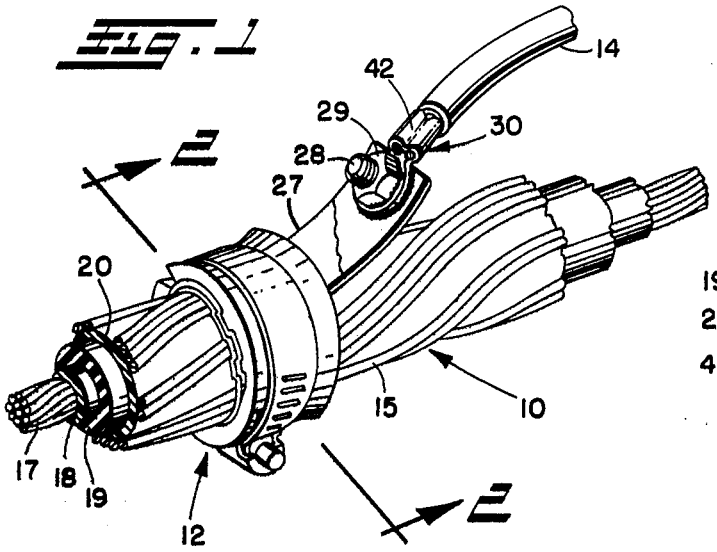
FIG. 1 is a perspective view illustrating the connection of the present invention applied to a URD cable.

Referring now to the drawing and more particularly to FIG. 1, there is illustrated a round wire concentric neutral URD cable at 10 to which the electrical connection 12 of the present invention is secured. The purpose of the electrical connection is to provide positive electrical contact between all of the concentric neutral round wires 15 and the lead 14. The lead 14 may be connected to a magnesium or zinc anode for cathodic protection of the cable. The lead 14 may also be a test wire.

The particular URD cable illustrated comprises a stranded aluminum or copper conductor 17 covered with an extruded layer of semiconducting material indicated at 18. Insulation 19 of the proper thickness surrounds the semiconducting material 18. As a shield, an extruded semiconducting insulation screen 20 is provided and finally a correct number of proper size solid copper neutral wires 15 are applied spirally. Although less common, the present invention is equally applicable to flat strap concentric neutral URD cables wherein the concentric neutral is formed by copper flat straps applied spirally.

Figure 3:
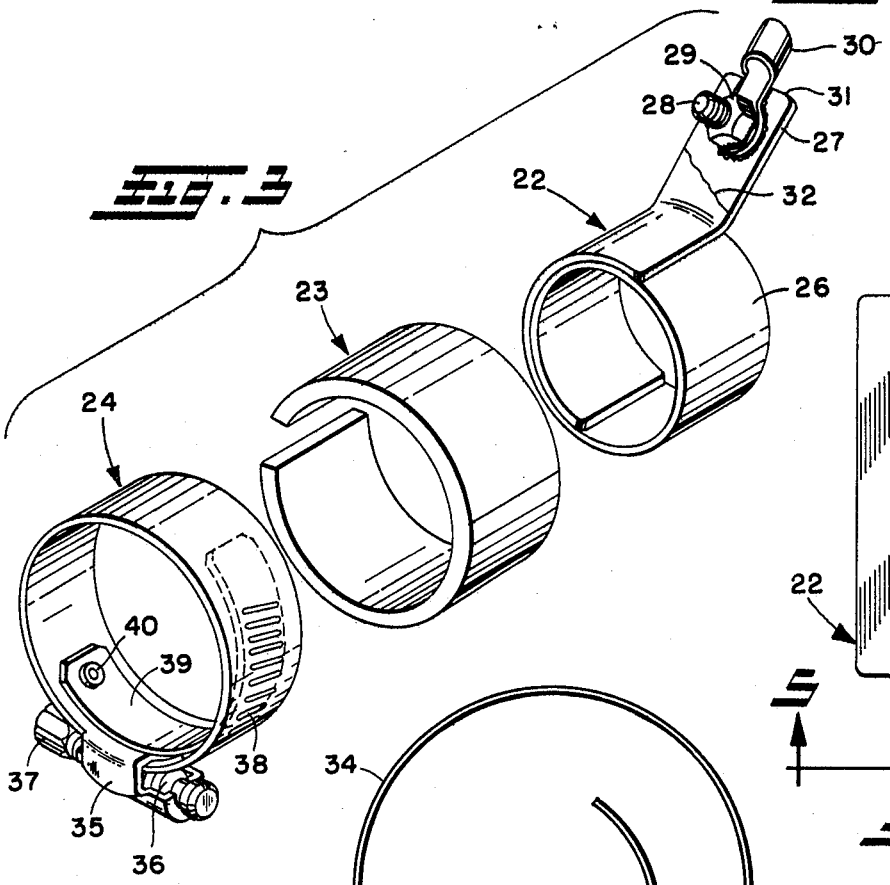
FIG. 3 is an exploded view illustrating the components of the connection in the position of assembly.

The connection 12 may be readily field formed from a kit comprising three components as seen more clearly in FIG. 3. Such components comprise an inner sleeve 22, a rubber or neoprene gasket 23, and an outer clamp 24.

Figure 4:
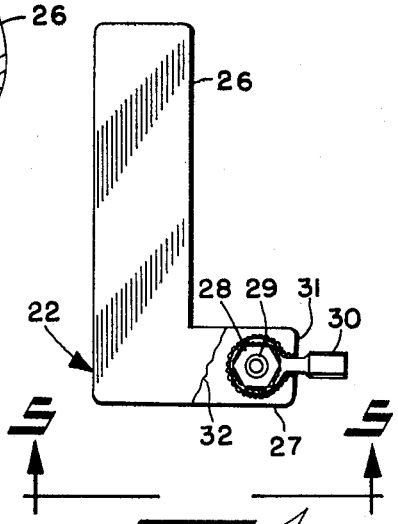
FIG. 4 is a top plan view of the tinned soft copper L-shaped sleeve, on a reduced scale, employed with the present invention.
Figure 5:
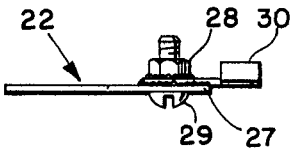
FIG. 5 is an end elevation of the sleeve as seen from the line 5—5 of FIG. 4.
Figure 6:
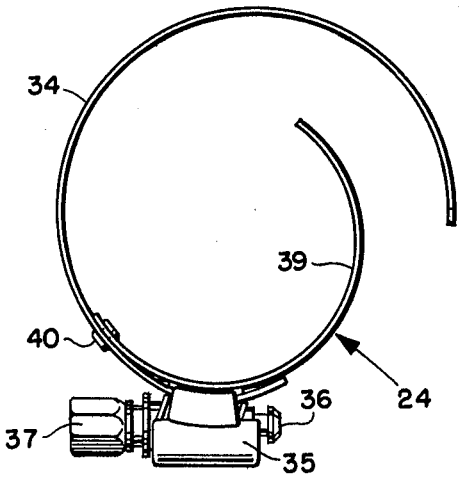
FIG. 6 is a detailed view of the hose clamp employed illustrating the special shim utilized therein.

Referring first to the inner sleeve, which is also shown in reduced scale in FIGS. 4 and 5, it will be seen that the inner sleeve is stamped from 0.013 gauge soft copper into the L-shape shown. The long leg 26 of the L may be approximately 7 inches in length, while the short leg 27 is approximately $2\frac{3}{8}$ inches in length and approximately $\frac{7}{8}$ inch wide. The use of soft copper provides a sleeve with no resilience so that when rolled into the shape shown in FIG. 3, it will remain in such shape. During stamping, a hole is stamped in the center of the short leg $\frac{1}{4}$ inch from the end of the tab formed by the short leg. After the stamping operation, the inner sleeve is then electro-tin plated so that there are no exposed copper edges.

In the hole thus formed in the short leg, a brass nut 28 and a brass bolt 29 are then used to connect a ring-tong crimp connector to the short leg 27 or tab of the inner sleeve. The ring-tong 30 of the connector projects beyond the edge 31 of the short leg of the sleeve. After the crimp connector is secured to the short leg of the inner sleeve in the manner shown, the entire assembly is then soldered, preferably by dipping the short leg 27 in a solder pot. The dip line of the solder is shown at 32.

The gasket 23 may preferably be of neoprene and in the kit will be approximately ⅛ inch thick by 1 inch wide by 7 inches in length.

The outer clamp 24 consists of a stainless steel hose clamp. The clamp includes stainless steel spring member 34, to one end of which is secured the housing 35 for the screw or worm 36 which may be rotated by the hex or screw head 37. The opposite end of the spring member 34 is provided with a series of pitched slots 38 which engage the screw 36 upon tightening.

Secured to the inside of the spring member 34 is a stainless steel shim 39. The shim is secured by the flush rivet indicated at 40. The shim is somewhat more narrow than the spring member 34 and serves to shield the slots 38 from the gasket member 23 and helps to distribute the stresses caused by the tightening of the clamp circumferentially around the cable. The shim thus aids in alleviating any stress concentrations which might cause damage to the semiconductor jacket or shield 20. Tests so far have indicated that it is impossible to overtighten the clamp and damage the semiconductor 20.

Figure 2:
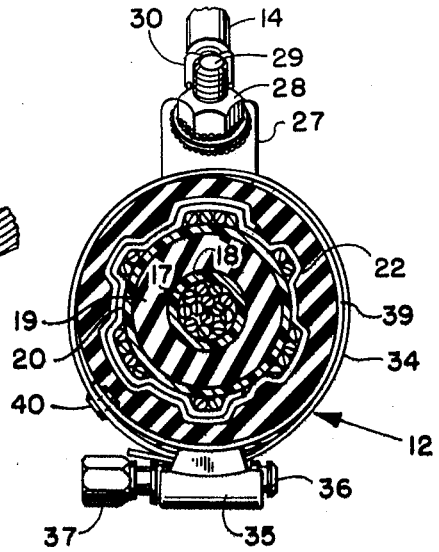
FIG. 2 is an enlarged, transverse section of the connection taken substantially on the line 2—2 of FIG. 1.

For installation, the long leg 26 of the tinned copper sleeve is wrapped around the cable over the neutral wires as seen in FIG. 3. Depending upon the size of the cable, the long leg of the sleeve will overlap itself as indicated. Because of the nature of the soft copper employed, once wrapped to the position seen in FIG. 3, it will remain in such position. The neoprene or rubber gasket 23 is then trimmed in length to approximately ¼ inch less than the circumference of the cable. The gasket is then placed over the inner sleeve 22 circumjacent thereto. The outer clamp is then placed around the gasket with the end of the spring member 34 being brought into engagement with the screw 36 and the screw tightened. The clamp should be tightened securely but not excessively. When tightened, as seen in FIG. 2, the sleeve 22 closely conforms to and is pressed against all of the exposed concentric neutrals. The anode or test lead wire 14 is then placed in the ring-tong 30 and crimped as indicated at 42 in FIG. 1. By providing the clamp with the ring-tong crimp connection soldered to the end of the tab 27, there is, of course, eliminated any necessity for a man in the field to tighten a connector to the tab 27. All he has to do is slip the lead into the ring-tong and crimp the same in place. Because of the projection of the ring-tong beyond the end of the tab, it is readily accessible to pliers or other crimping tools.

The entire connection 12 should then be coated with a dielectric coating compatible with the semiconducting jacket 20.

It can now be seen that there is provided a positive anode and test lead wire electrical connection which can readily be field fabricated from a simplified kit to achieve a positive electrical contact between the anode or test lead wire and all of the URD concentric neutrals.

I, therefore, particularly point out and distinctly claim as my invention:

1. A wrap type electrical connection for the exposed concentric neutrals of a URD cable comprising an L-shape tin coated soft copper inner sleeve, the long leg of the L being adapted to be wrapped circumferentially of the cable in overlapping fashion, a gasket circumjacent the sleeve, and a clamp surrounding said gasket and tightened to constrict said gasket and thus said sleeve about said cable, and a lead electrically connected to the short leg of the L.

2. A connection as set forth in claim 1 including a crimp connector secured to and projecting from the short leg of the L.

3. A connection as set forth in claim 2 wherein said crimp connector is a ring-tong bolted to the short leg of the L.

4. A connection as set forth in claim 3 wherein said ring-tong projects beyond the end of the short leg of the L.

5. A connection as set forth in claim 4 wherein the ring-tong and its bolted connection to the short leg of the L is dip soldered.

6. A connection as set forth in claim 2 wherein said inner sleeve is completely electro-tinned prior to said crimp connector being secured thereto.

7. A connection as set forth in claim 1 wherein said clamp is a screw type hose clamp and includes an inner shim circumferentially to distribute stresses caused by tightening of said clamp.

8. A connection as set forth in claim 2 wherein said crimp connection is secured to said short leg of the L by a brass bolt and nut.

9. A kit for forming a positive electrical connection for all of the exposed concentric neutrals of a URD cable comprising an L-shape inner sleeve element, the long leg of the L being adapted to be wrapped circumferentially around said cable, the short leg having a preassembled connector thereon, an elongated gasket adapted to be trimmed to be slightly shorter than the circumference of the cable and wrapped circumjacent the long leg of the L, and a clamp adapted to surround said gasket when thus wrapped and when tightened to constrict said gasket and said sleeve about said cable.

10. A kit as set forth in claim 9 wherein said inner sleeve is stamped from soft copper and completely electro-tinned.

11. A kit as set forth in claim 9 wherein said preassembled connector comprises a ring-tong crimp connector bolted to the short leg of the L.

12. A kit as set forth in claim 11 wherein the ring-tong of said crimp connector projects beyond the end of the short leg of the L.

13. A kit as set forth in claim 11 wherein said ring-tong crimp connector is secured to the short leg of the L by a brass nut and bolt.

14. A kit as set forth in claim 13 wherein the short leg of the L including the crimp connector and the nut and bolt is dip soldered.

15. A kit as set forth in claim 9 wherein said clamp includes an inner shim operative to distribute tightening stresses circumferentially around the cable.

16. A kit as set forth in claim 9 wherein said clamp includes an outer stainless steel spring element, a screw and housing secured to one end of said element, said screw being adapted to engage pitched slots on the other end of said element to tighten said element as said screw is rotated, and an inner shim flush riveted to said outer element to shield said slots and uniformly circumferentially to constrict said gasket.

* * * * *